US010799805B2

(12) United States Patent
Hama et al.

(10) Patent No.: US 10,799,805 B2
(45) Date of Patent: Oct. 13, 2020

(54) SPINNING TOP LAUNCHING DEVICE

(71) Applicant: TOMY COMPANY, LTD., Tokyo (JP)

(72) Inventors: Hiroyuki Hama, Tokyo (JP); Douglas Arthur Schultheis, Cumberland, RI (US); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 16/506,136

(22) Filed: Jul. 9, 2019

(65) Prior Publication Data

US 2020/0129872 A1 Apr. 30, 2020

Related U.S. Application Data

(60) Provisional application No. 62/750,933, filed on Oct. 26, 2018.

(51) Int. Cl.

| | |
|---|---|
| ***A63H 1/02*** | (2006.01) |
| *A63H 17/00* | (2006.01) |
| *A63H 1/04* | (2006.01) |

(52) U.S. Cl.

CPC ..... *A63H 1/02* (2013.01); *A63H 1/04* (2013.01)

(58) Field of Classification Search

CPC ... A63H 1/00; A63H 1/04; A63H 1/12; A63H 1/02; A63H 17/008; A63H 17/004; A63H 1/32

USPC ..... 446/259, 261–263

See application file for complete search history.

(56) References Cited

U.S. PATENT DOCUMENTS

| | | | | |
|---|---|---|---|---|
| 8,715,032 | B2 * | 5/2014 | Horikoshi | A63H 1/12 446/256 |
| 2011/0306269 | A1 * | 12/2011 | Horikoshi | A63H 1/12 446/261 |
| 2015/0017872 | A1 * | 1/2015 | Choi | A63H 1/04 446/259 |

FOREIGN PATENT DOCUMENTS

| | | |
|---|---|---|
| JP | 6232154 B1 | 11/2017 |

* cited by examiner

*Primary Examiner* — Kien T Nguyen

(74) *Attorney, Agent, or Firm* — IP Business Solutions, LLC

(57) ABSTRACT

The spinning top launching device includes a rotary drive mechanism being configured to be rotated by the operation member and configured to apply rotary force to the spinning top, a rotation speed detection mechanism including a centrifugal clutch mechanism being configured to be rotated by the operation member, and an operation body being engaged with an output side of the centrifugal clutch mechanism to be moved in a first direction from a predetermined position. The operation body includes an indication part configured to indicate the rotation speed.

4 Claims, 5 Drawing Sheets

SPINNING TOP LAUNCHING DEVICE

CROSS-REFERENCE TO THE RELATED APPLICATION

The present application claims priority under 35 U.S.C. 119 to U.S. Provisional Application No. 62/750,933 filed on Oct. 26, 2018. The entire content of U.S. Provisional Application No. 62/750,933 is incorporated herein by reference.

BACKGROUND

Field of the Invention

The present invention relates to a spinning top launching device.

Description of Related Art

Conventionally, a spinning top launching device provided with a rotation speed detection mechanism, which detects a rotation speed of a launched spinning top, is well-known (e.g., Patent Document 1).

The rotation speed detection mechanism of the spinning top launching device described in Patent Document 1 is provided with a cam, which is operated by an operation of an actuating member, and a detection part which is intermittently operated by the cam operation, and a rotation speed is detected based an output signal of the detection part.

[Patent Document 1] Japanese Patent No. 6232154

SUMMARY

However, when an electrical circuit or the like is used for detecting the rotation speed, the spinning top launching device becomes expensive. An object of the present invention is to provide a spinning top launching device, which detects a rotation speed by a mechanical mechanism incorporated into a device case, and relatively inexpensive.

In view of the above problem, a spinning top launching device for spinning a spinning top, is provided. The spinning top launching device includes a rotary drive mechanism being configured to be rotated by the operation member and configured to apply rotary force to the spinning top, a rotation speed detection mechanism including a centrifugal clutch mechanism being configured to be rotated by the operation member, and an operation body being engaged with an output side of the centrifugal clutch mechanism to be moved in a first direction from a predetermined position. The operation body includes an indication part configured to indicate the rotation speed.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

DETAILED DESCRIPTION OF THE PREFERRED EMBODIMENTS

Hereinafter, a spinning top launching device of the present invention will be described based on embodiments shown the drawings.

Whole Structure

Figure 1:
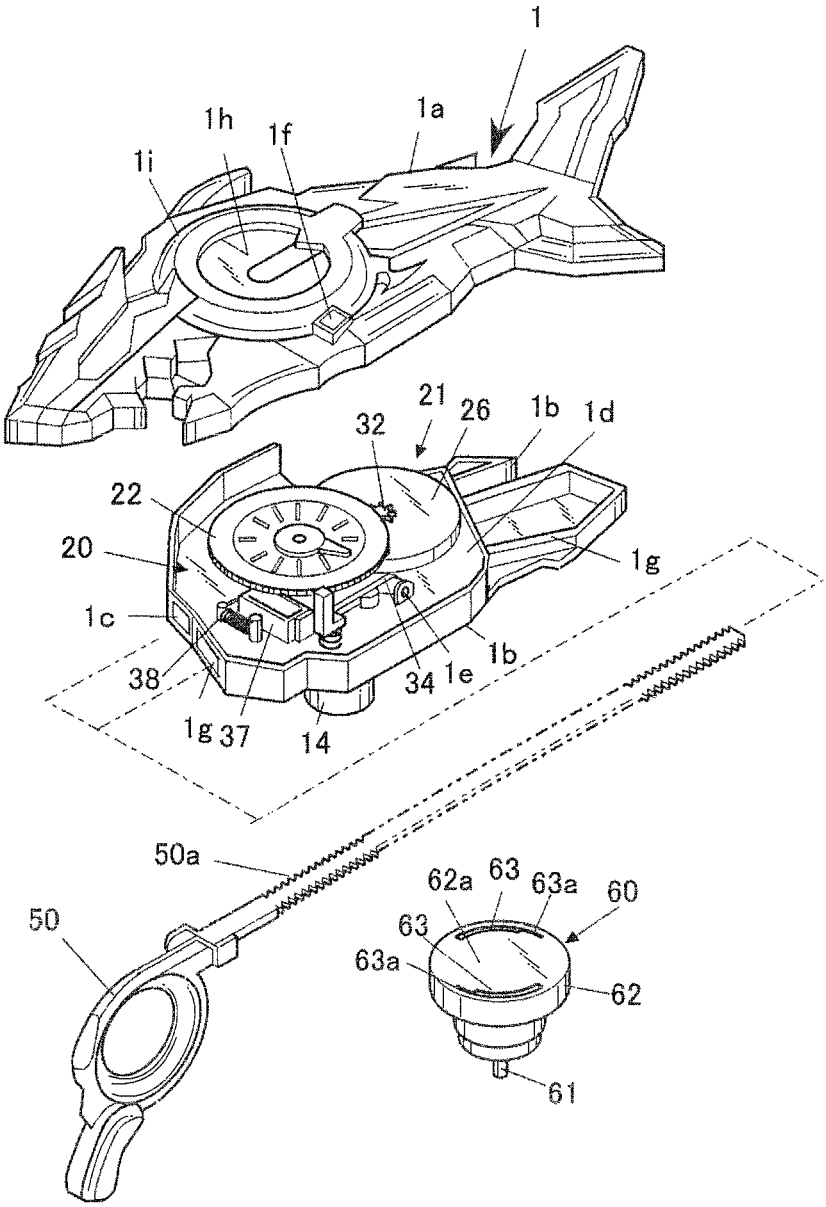
FIG. 1 is an exploded perspective view showing a spinning launching device and a launcher according to an embodiment.
Figure 2:
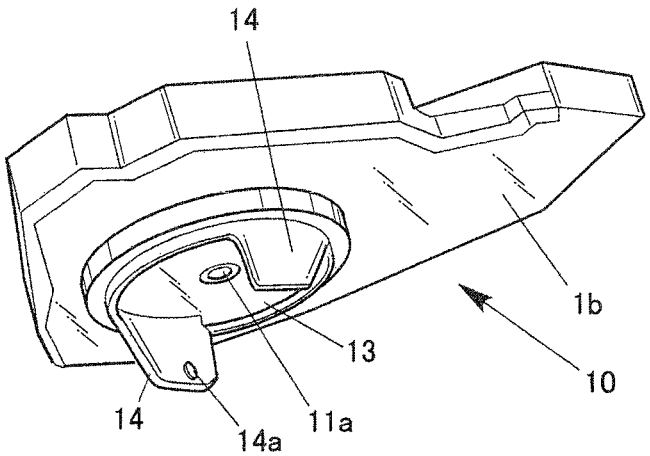
FIG. 2 is a perspective view showing a lower part of the spinning top launching device.

FIG. 1 shows a perspective view showing a condition in which an upper cover 1*a* of a spinning top launching device is separated from a lower part case 1*b*. FIG. 2 is a perspective view showing a lower part of a spinning top launching device.

The spinning top launching device is provided with a rotary drive mechanism 10 operated by an operation of a rack belt 50 which is one of the operation members, and a rotation speed detection mechanism 20. Among these, the rotary drive mechanism 10 applies a rotary energizing force to a spinning top 60 by the operation of the rack belt 50. Further, the rotation speed detection mechanism 20 detects a rotation speed of the spinning top 60 based on the operation of the rack belt 50.

By the way, the spinning top launching device has belt insertion paths 1*c*, 1*g* in which the rack belt 50 is freely and slidably stored.

Detailed Structure

1. Regarding the Rotary Drive Mechanism 10 and the Spinning Top 60

Figure 3:
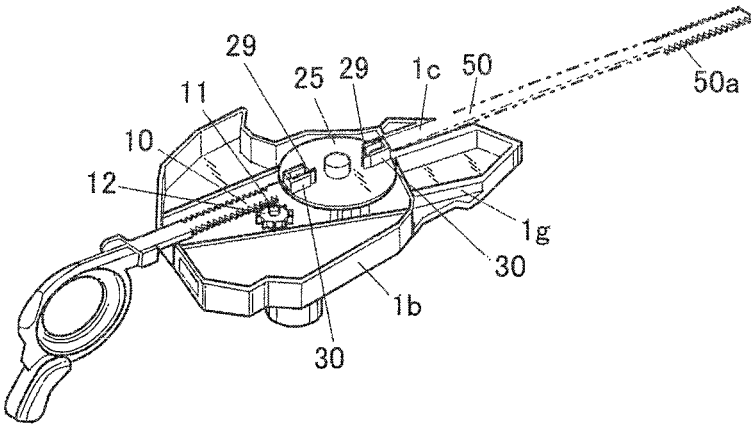
FIG. 3 is a perspective view showing an inner part of the spinning top launching device.

The rotary drive mechanism 10 is provided with an output shaft 11 in the lower case 1*b* of the device case 1 (see FIG. 3). In the output shaft 11, a pinion 12 which meshes with the rack 50*a* of the rack belt 50 is securely provided. As shown in FIG. 2, in the output shaft 11, an end part 11*a* extends outward of the lower part case 1*b*, and a disk 13 is fixed to the end part 11*a*. In the peripheral edge of the disk 13, two circular arc-shaped forks 14 are erected in a symmetrical position to the shaft center of the disk 13. In the inner surface of the forks 14, a projection 14*a* is formed.

On the other hand, as shown in FIG. 1, the spinning top 60 is provided with a shaft part 61 and a body 62. In the body 62, an upper surface 62*a* is formed flat. On the upper surface 62*a*, two arcuate slits 63 are formed in positions which are symmetrical to the shaft center. In the arcuate slits 63, the width of one end part 63*a* in the circumferential direction is narrower than other part. The spinning top 60 shown in FIG. 1 should be rotationally energized in the clockwise direction, so that the width of the end part in the front side of the arcuate slits 63 in the clockwise direction becomes narrow. In a case in which the spinning top 60 is rotationally energized in the counterclockwise direction, the other end part which is opposite end part of the end part shown in FIG. 1 becomes narrow.

Figure 5:
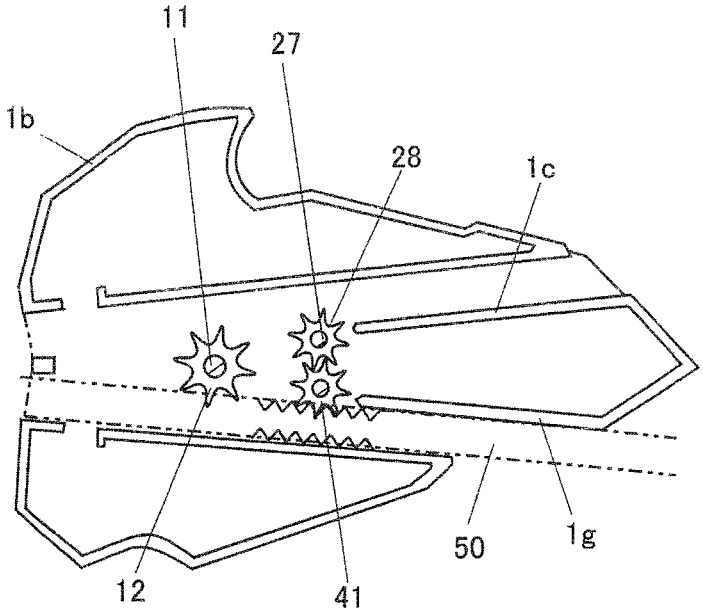
FIG. 5 is a plane view showing a belt insertion path of a rack belt in the spinning top launching device.

In the spinning top launching device provided with the rotary drive mechanism 10, first, the rack belt 50 is inserted inside the device case 1. In this case, when the spinning top 60 should be energized in the clockwise direction, the rack belt 50 is inserted into the belt insertion path 1*g* (see FIG. 5). When the spinning top 60 should be energized in the counterclockwise direction, the rack belt 50 is inserted into the belt insertion path 1*c*. Next, alternatively, before inserting the rack belt 50, the forks 14 of the spinning top launching device are fitted in the arcuate slits 63 of the spinning top 60, and the spinning top 60 is rotated in a manner of moving the forks 14 in the direction of the narrow width of the arcuate slits 63, so that the forks 14 are positioned at the end part of the narrow width side of the arcuate slits 63. In this condition, the projections 14*a* of the forks 14 are slipped to the lower edge of the arcuate slits 63 and are engaged to the edge. With this, even when holding the spinning top launching device in a situation in which the spinning top 60 is placed down, the spinning top 60 is held by the forks 14, so as to prevent the spinning top 60 from falling from the forks 14.

In the condition in which the spinning top 60 is placed down, when the rack belt 50 is pulled off from the spinning top launching device, the output shaft 11 is rotated through the pinion 12, accordingly, the forks 14 are rotated around the shaft center of the disk 13, so as to rotate the spinning top 60 by the forks 14. After that, when the rack 50*a* of the rack belt 50 is separated from the pinion 12, the forcible rotation of the disk 13 is lost. However, the spinning top 60 continues to be rotated by the inertia force. With this, the projections 14*a* of the forks 14 are displaced to the wide width side of the arcuate slits 63 of the spinning top 60, so that the engagement between the spinning top 60 and the fork 14 is released and the spinning top 60 is launched from the spinning top launching device.

2. Regarding Rotation Speed Detection Mechanism 20

The rotation speed detection mechanism 20 is provided with a centrifugal clutch mechanism 21 operated by the operation of the rack belt 50, a rotation body 22 which is rotationally driven in one direction by connecting with the centrifugal clutch mechanism 21 and displaying rotation speed, a spring 38 which functions as a rotational resistance of the rotation body 22 and returns the rotation body 22 to an initial position, a ratchet mechanism 24 which allows rotation of the rotation body 22 in one direction and prevents the rotation body 22 from rotating in the other direction, and a reset mechanism which makes the ratchet mechanism 24 as non-operation condition.

Figure 6:
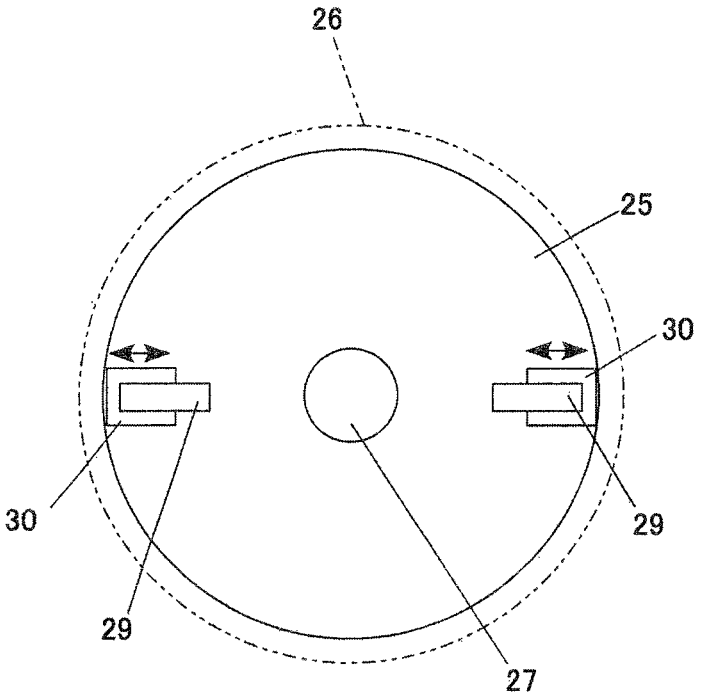
FIG. 6 is a plane view showing a centrifugal clutch mechanism in the spinning top launching device.

As shown in FIGS. 3 and 6, the centrifugal clutch mechanism 21 is provided with a disk-shaped shoe support 25 which is rotationally driven by the rack belt 50, shoes 30 which are movable in a radial direction of the shoe support 25, and a drum rim 26 which is arranged to cover the shoe support 25.

In the lower part of the rotation shaft 27 of the shoe support 25, a pinion 28 (see FIG. 5) is fixed as an input gear. A part of tooth of the pinion 28 is projected to the belt insertion path 1*c* and is meshed with the rack 50*a* of the rack belt 50 which is inserted. Further, another pinion 41 (see FIG. 5) is meshed with the pinion 28 as the input gear in the same shape. A part of tooth of another pinion 41 is projected to the belt insertion path 1*g* and is meshed with the rack 50*a* of the rack belt 50 which is inserted. As described, the two pinions 28 and 41 are provided as the input gear of the rotation speed detection mechanism 20 because regardless the rotationally energized direction of the spinning top 60, the rotation direction of the rotation body 22 is the same and it becomes easy to see the display part showing the rotation speed.

Further, in the upper surface of the shoe support 25, as shown in FIGS. 3 and 6, two straight rod-shaped guide pieces 29 which extend in the radial direction are provided. In each of the guide pieces 29, a U-shaped shoe 30 is slidably held in the radial direction.

The drum rim 26 is rotatably held to the rotation shaft 27, and an abutting surface on which the shoe 30 abuts is formed in the inner circumferential surface.

According to the centrifugal clutch mechanism 21 with such structure, when the rack belt 50 is inserted into the insertion path 1*c*, the rack 50*a* is meshed with the pinion 28. Further, when the rack belt 50 is inserted into the belt insertion path 1*g*, the rack 50*a* is meshed with the pinion 41. When the rack belt 50 is pulled, the pinion 28 is rotated directly or through the pinion 41 and accordingly, the shoe support 25 is rotated. When the centrifugal force exceeds a predetermined value, the shoes 30 are moved radially outward, and the shoes 30 abut to the inner circumferential surface of the drum rim 26 in the force which corresponds to the rotation speed of the shoe support 25. With this, the drum rim 26 is rotated.

Figure 4:
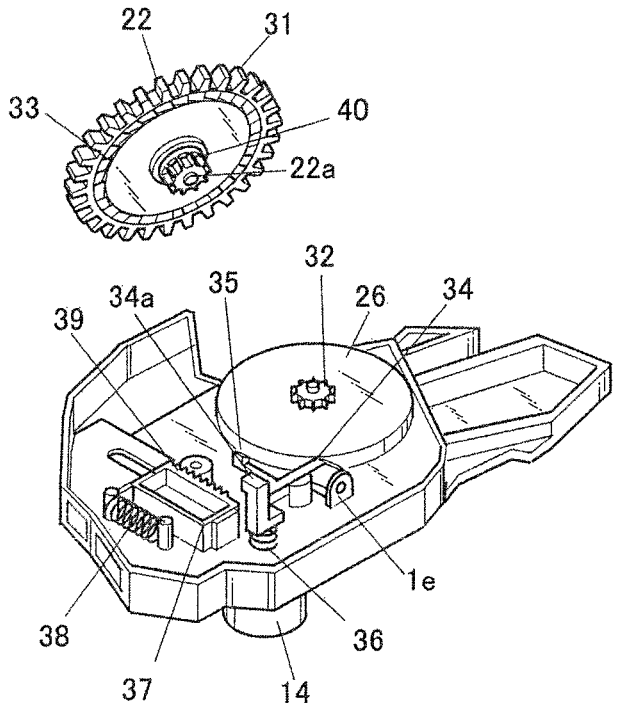
FIG. 4 is a perspective view showing an inner part of the spinning top launching device.
Figure 7:
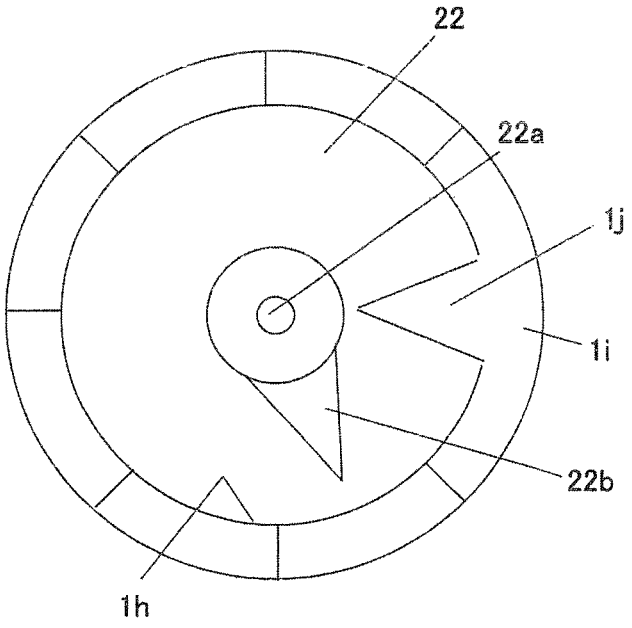
FIG. 7 is a plane view showing a rotation body and its vicinity in the spinning top launching device.

As shown in FIGS. 1 and 7, the rotation body 22 is provided with an indication part 22*b* such as an arrow, etc. on the upper surface. The shaft 22*a* of the rotation body 22 is rotatably supported in the device case 1. As shown in FIG. 4, in the peripheral surface of the rotation body 22, a gear 31 is formed. The gear 31 is meshed with the gear 32 fixed on the upper surface of the drum rim 26. The rotation body 22 is arranged under an approximately circular-shaped window 1*h* formed in the upper cover 1*a*. A scale is marked at predetermined intervals in a circumferential direction of the window frame 1*i* which defines a window 1*h*. Further, a mountain-shaped projection 1*j* which projects in a direction toward the center is formed in the window frame 1*h*. An adjacent position of the projection 1*j* and the tip of an indication part 22*b* becomes an initial position of the rotation body 22. In detail, an adjacent position which is the position where the indication part 22*b* proceeds more than the projection 1*j* in the rotation direction of the rotation body 22 is the initial position.

In this embodiment, the indication part 22*b* is provided in the rotation body 22 side, and the scale is provided in the window frame 1*i* side. However, on the other hand, the scale may be provided in the rotation body 22*b* side, and the indication part may be provided in the window frame 1*i* side.

Figure 8:
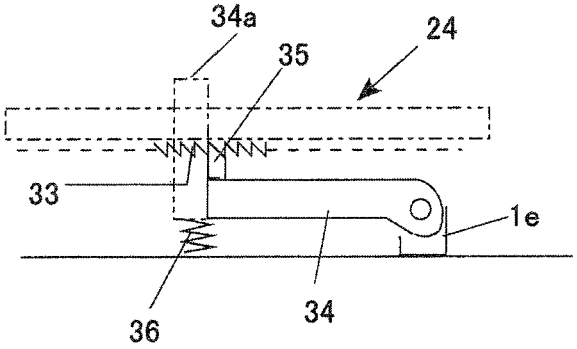
FIG. 8 is a side view showing a ratchet mechanism in the spinning top launching device.

Further, in the lower surface of the rotation body 22, as shown in FIGS. 4 and 8, saw blade-shaped ratchet tooth 33 are formed just inside in the radial direction of the outer peripheral in the circumferential direction. On the other hand, as shown in FIG. 1, inside the lower part case 1*b*, a partition wall plate 1*d* covering the upper surface of the lower part case is placed. In the upper surface of the partition wall plate 1*d*, as shown in FIGS. 4 and 8, a bracket 1*e* is erected. In the bracket 1*e*, a base end of a lever 34 is supported and freely swings. In the other end side of the lever 34, a ratchet claw 35 is formed.

In a space between the other end of the lever 34 and the partition wall plate 1*d*, a spring 36 exists, and by this spring, the ratchet claw 35 of the lever 34 is meshed with the ratchet tooth 33 formed on the rotation body 22. The ratchet mechanism 24 is configured with the lever 34, the ratchet tooth 33, the ratchet claw 35, and the spring 36. Further, in the tip end of the lever 34, a reset button 34*a* is erected. The reset button 34*a* is held in a state of projecting upward from a hole 1*f* formed in the upper cover 1*a*. By pressing the reset button 34*a* against the energizing force of the spring 36, the meshing between the ratchet claw 35 and the ratchet tooth 33 is released. The reset mechanism is configured with the lever 34, the reset button 34*a*, and the spring 36.

Figure 9:
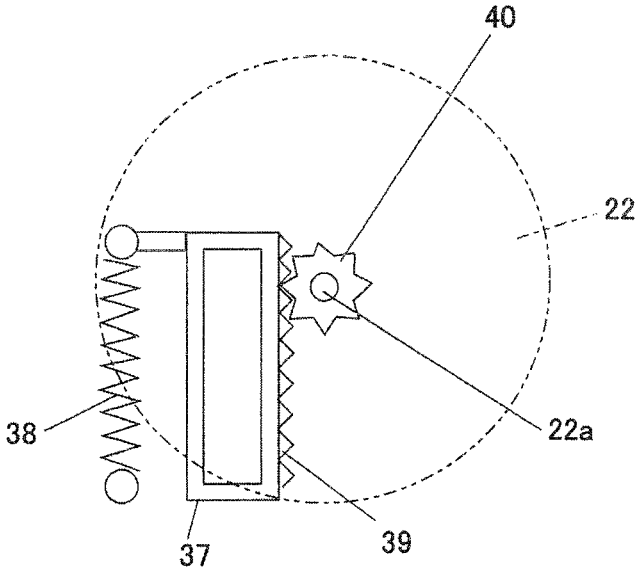
FIG. 9 is a plane view showing a connection relationship between an energizing member and a rotation body in the spinning top launching device.

Further, as shown in FIGS. 4 and 9, in the rotation speed detection mechanism 20, a slide block 37 is provided on the upper surface of the partition wall plate 1*d*. The slide block 37 is configured to be capable of being reciprocated linearly, and it is urged by the spring 38 in one direction. On the side surface of the slide block 37, a rack 39 is formed. The rack 39 is meshed to the gear 40 fixed on the shaft 22*a* of the rotation body 22. In this case, when the slide block 37 is returned by the energizing force of the spring at a predetermined position, it is set in which the rotation body 22 is positioned in the initial position.

In the rotation speed detection mechanism 20 with such configuration, when the rack belt 50 inserted into the belt insertion path 1*c* or 1*g* of the device case 1 is pulled and the drum rim 26 is rotated, the rotation body 22 is rotated through the gear 32, and the slide block 37 is slid through the gear 40 and the rack 39 in one direction against the energizing force of the spring 38. Therefore, the rotational resistance corresponding to the energizing force of the spring 38 is also applied to the rotation body 22.

In the middle of the operation pulling off the rack belt 50 or after pulling off the rack belt 50, when the rotation speed of the centrifugal clutch mechanism 21 becomes slow, the rotation body 22 tries a reverse rotation due to the energizing force of the spring 38. However, the reverse rotation is blocked by the ratchet mechanism 24.

In this way, when the rotation speed of the rotation body 22 becomes the maximum, the rotation speed is displayed in the rotation body 22.

By the way, in order to return the rotation body 22 at the initial position, the reset button 34*a* of the lever 34 which is projected from the hole 1*f* of the upper cover 1*a* is pressed in. Then, the ratchet claw 35 is separated from the ratchet tooth 33, the movement of the slide block 37 becomes possible. Therefore, the slide block 37 is returned by the energizing force of the spring 38. Accordingly, the rotation body 22 is returned to the initial position through the rack 39 and the gear 40.

The embodiments of the present invention were described above, but the present invention is not limited to the aforementioned embodiments, and needless to say, various modifications may be made within the scope that does not depart from the essential point of the present invention.

For example, in the spinning top launching device of the aforementioned embodiment, the rotation body 22 indicating rotation speed is independently set in the drum rim 26. However, for example, the drum rim 26 itself can be the rotation body.

Further, in the spinning top launching device of the aforementioned embodiment, the display part for rotation speed is provided in the rotation body 22. However, the operation body which is reciprocated linearly as the slide block 37 can be a display part for rotation speed. In this case, an indication part may be provided in the operation body, and a scale indicated by an indication part may be provided on the side of the operation body, or the scale may be provided on the operation body and the indication part may be provided on the side of the operation body.

Further, in the spinning top launching device of the aforementioned embodiment, as the reset mechanism, the reset button 34*a* of the lever 34 is exposed outside from the device case 1, and by pressing it by a hand, the ratchet mechanism 24 becomes non-operation condition. However, the end part of the lever 34 faces the belt insertion paths 1*c*, 1*g*, and when the rack belt 50 is inserted into the device case 1, the lever 34 is operated by the rack belt 50, and the ratchet mechanism 24 may be non-operation condition.

Further, in the spinning top launching device of the aforementioned embodiment, for example, the rack belt 50 is mentioned as an operation member. However, the operation member may be a string. In this case, when the operation is not performed, it is preferable that the string is wound on the drum by a coil spring.

Furthermore, in the spinning top of the aforementioned embodiment, the spring 38 which returns the rotation body 22 to the initial position is used as the rotation resistance of the rotation body 22. However, if it is simply used as operation resistance of the rotation body 22 or other operation body. For example, the spring 38 is not provided and the slide block 37 may be made heavier or the slide block 37 may be configured by a material having high friction resistance, etc. so that it may be function as a resistor.

EFFECT OF THE INVENTION

When the spinning top is rotationally energized by the operation of the operation member, a rotation speed is displayed by the operation force of the operation member. Therefore, it is not necessary to use an expensive way such as an electrical circuit or an electronic circuit, etc. to detect the rotation speed, and an inexpensive spinning top launching device can be realized.

The operation body displaying the rotation speed becomes the rotation body, so that the range of which the indication part indicates becomes relatively large. Therefore, visible display part can be realized.

The return is prevented by the ratchet mechanism, so that it is possible to detect the rotation speed at the time of maximum rotation speed. Further, the movement of the operation body can be appropriately controlled by the resistance member, and by the reset mechanism, it is possible to return the operation body to the initial position.

When the spinning top is rotationally energized in the clockwise direction, when the spinning top is rotationally energized in the counterclockwise direction, in either direction, the moving direction of the operation body can be the same, so that visible display part can be realized.

What is claimed is:

1. A spinning top launching device for spinning a spinning top, comprising:

an operation member;

a rotary drive mechanism being configured to apply rotary force to the spinning top by a user operating the operation member; and a rotation speed detection mechanism including a centrifugal clutch mechanism being configured to be rotated by the operation member, and an operation body being engaged with an output side of the centrifugal clutch mechanism to be moved in a first direction from a predetermined position the operation body including an indication part configured to indicate the rotation speed.

2. The spinning top launching device according to claim 1, wherein the operation body is rotatable.

3. The spinning top launching device according to claim 1, wherein the rotation speed detection mechanism includes a ratchet mechanism being engaged with the operation body to allow the operation body in rotating in the first direction and to prevent the operation body from rotating in a second direction opposite to the first direction, a urging member configured to urge the operation body toward the predetermined position while moving the operation body in the first direction, and a reset mechanism being configured to allow the operation body in rotating in the second direction by releasing the rachet mechanism.

4. The spinning top launching device according to claim 1, further comprising a device in which the rotary drive mechanism, the rotation speed detection mechanism, and the operation body are accommodated, first, second, and third input gears, and first and second belt insertion paths, wherein the operation member is a rack belt, the first input gear constitutes a part of the rotary drive mechanism and is configured to mesh with a rack of the rack belt, on a first side of the first input gear, the first belt insertion path to which the first input gear faces is formed, on a second side of the first input gear, the second belt insertion path to which the first input gear faces is formed, the first belt insertion path is for spinning the spinning top in the first direction, the second belt insertion path is for spinning the spinning top in the second direction, the second input gear constitutes a part of the rotation speed detection mechanism, is configured to mesh meshes with the rack of the rack belt inserted in the first belt insertion path, and is connected with the centrifugal clutch mechanism, the third input gear constitutes a part of the rotation speed detection mechanism, is configured to mesh with the rack of the rack belt inserted in the second belt insertion path, and is connected with the centrifugal clutch mechanism through the second input gear.

* * * * *